US011096417B2

(12) United States Patent
Delgado et al.

(10) Patent No.: US 11,096,417 B2
(45) Date of Patent: Aug. 24, 2021

(54) MODULAR WATER PIPE AND METHOD OF MANUFACTURE

(71) Applicant: JOKR Design Company, LLC, Austin, TX (US)

(72) Inventors: Santiago Delgado, Austin, TX (US); Parker Kilgo, Austin, TX (US)

(73) Assignee: JOKR Design Company, LLC, Austin, TX (US)

( * ) Notice: Subject to any disclaimer, the term of this patent is extended or adjusted under 35 U.S.C. 154(b) by 106 days.

(21) Appl. No.: 16/422,635

(22) Filed: May 24, 2019

(65) Prior Publication Data

US 2020/0367552 A1 Nov. 26, 2020

(51) Int. Cl.
*A24F 1/30* (2006.01)

(52) U.S. Cl.
CPC ..... *A24F 1/30* (2013.01); *A24F 2700/03* (2013.01)

(58) Field of Classification Search
CPC ..... A24F 1/30; A24F 7/02
See application file for complete search history.

(56) References Cited

U.S. PATENT DOCUMENTS

| | | | | |
|---|---|---|---|---|
| 2002/0069886 | A1 | 6/2002 | Couch | |
| 2012/0180803 | A1 | 7/2012 | Beloni | |
| 2012/0199572 | A1 | 8/2012 | Shen et al. | |
| 2015/0374032 | A1 | 12/2015 | De Gaglia | |
| 2018/0220701 | A1 | 8/2018 | Risolia et al. | |
| 2018/0360107 | A1* | 12/2018 | Gonzalez | A24F 1/02 |
| 2020/0352222 | A1* | 11/2020 | Larsen | A24F 5/10 |

OTHER PUBLICATIONS

International Search Report and Written Opinion dated Aug. 11, 2020 for corresponding International Application No. PCT/US2020/034469.

* cited by examiner

*Primary Examiner* — Eric Yaary
(74) *Attorney, Agent, or Firm* — H. Artoush Ohanian

(57) ABSTRACT

A modular water pipe and method of manufacture in one embodiment includes a reservoir with detachable chimney. The chimney may include a mouthpiece module and optional extension and/or percolation modules. Modules may be threaded together. The reservoir and chimney may be constructed of glass and may include metallic rings fixed thereto to allow threading or other selectively removable connection of the components. A down stem may be threaded to a bowl adapter assembly to allow use of a single down stem with bowls of varying size. The rings may be bonded to the glass components using an adhesive, or they may be press-fit thereto.

16 Claims, 7 Drawing Sheets

MODULAR WATER PIPE AND METHOD OF MANUFACTURE

TECHNICAL FIELD

The present disclosure relates generally to apparatus, accruement and accessories related to the smoking of tobacco, herbs or other plant material, and specifically to water pipe systems and methods of manufacture.

BACKGROUND

Water pipes in various forms have been extant for centuries. They operate by passing the combustion gases of tobacco or other herbs or off-gases of heated oils and concentrates through a body of water, which cools and filters the smoke thereby providing the user with a more enjoyable smoking experience. For example, the hookah pipe, readily identifiable by its ornate candlestick shape and one or more long hoses, originated in India in the $15^{th}$ century and is still in use today.

Another type of water pipe, colloquially referred to as a bong, is shown in FIG. 1. Although variations exist, FIG. 1 illustrates a typical "beaker bong" water pipe of this class. "Beaker" is a misnomer, however, as the water pipe of FIG. 1 is characterized by the shape of an Erlenmeyer flask rather than the shape of a beaker.

Referring to FIG. 1, water pipe 10 includes a frustoconical reservoir 12 in which water or other cooling and filtering liquid 13 is held. A hollow down stem 14 is received into reservoir 12. A medial end of down stem 14 includes a set of slits or other openings 16 on the bottom through which smoke is introduced into filtering liquid 13. The distal end of the down stem 14 is adapted to receive a bowl 18 into which tobacco or other plant material is placed for combustion. The Erlenmeyer flask neck portion of water pipe 10, designated as chimney 20, includes a percolator 22. Percolator 22 includes a standpipe 24 in fluid communication with reservoir 12. Standpipe 24 is fluidly coupled to a percolation chamber 26. Percolation chamber 26 includes a plurality of percolation apertures 28 that introduce tiny bubbles of combustion product into a filtering liquid 29 that surrounds percolator 22. Chimney 20 also includes a number of interiorly facing indentations 30 which act to capture optional ice cubes (not illustrated) above the indentations 30 within chimney 20. The upper end of chimney 20 terminates in a mouthpiece 32.

In operation, the user places his or her mouth over mouthpiece 32 and inhales while combusting tobacco in bowl 18 with a match or other flame source. The negative pressure induced in water pipe 10 due to inhalation causes smoke from bowl 18 to pass through down stem 14, slits 16, and filtering fluid 17 into the interior volume of reservoir 12. The smoke then travels through standpipe 24 into percolation chamber 26. From percolation chamber 26, the smoke passes through apertures 28, filtering fluid 29 and into the upper portion of chimney 20. By removing bowl 18 while continuing to inhale, the negative pressure is rapidly equalized, and the volume of smoke held within water pipe 10 is rapidly introduced into the user's lungs.

BRIEF DESCRIPTION OF THE DRAWINGS

Embodiments are described in detail hereinafter with reference to the accompanying figures, in which.

DETAILED DESCRIPTION

Figure 1:
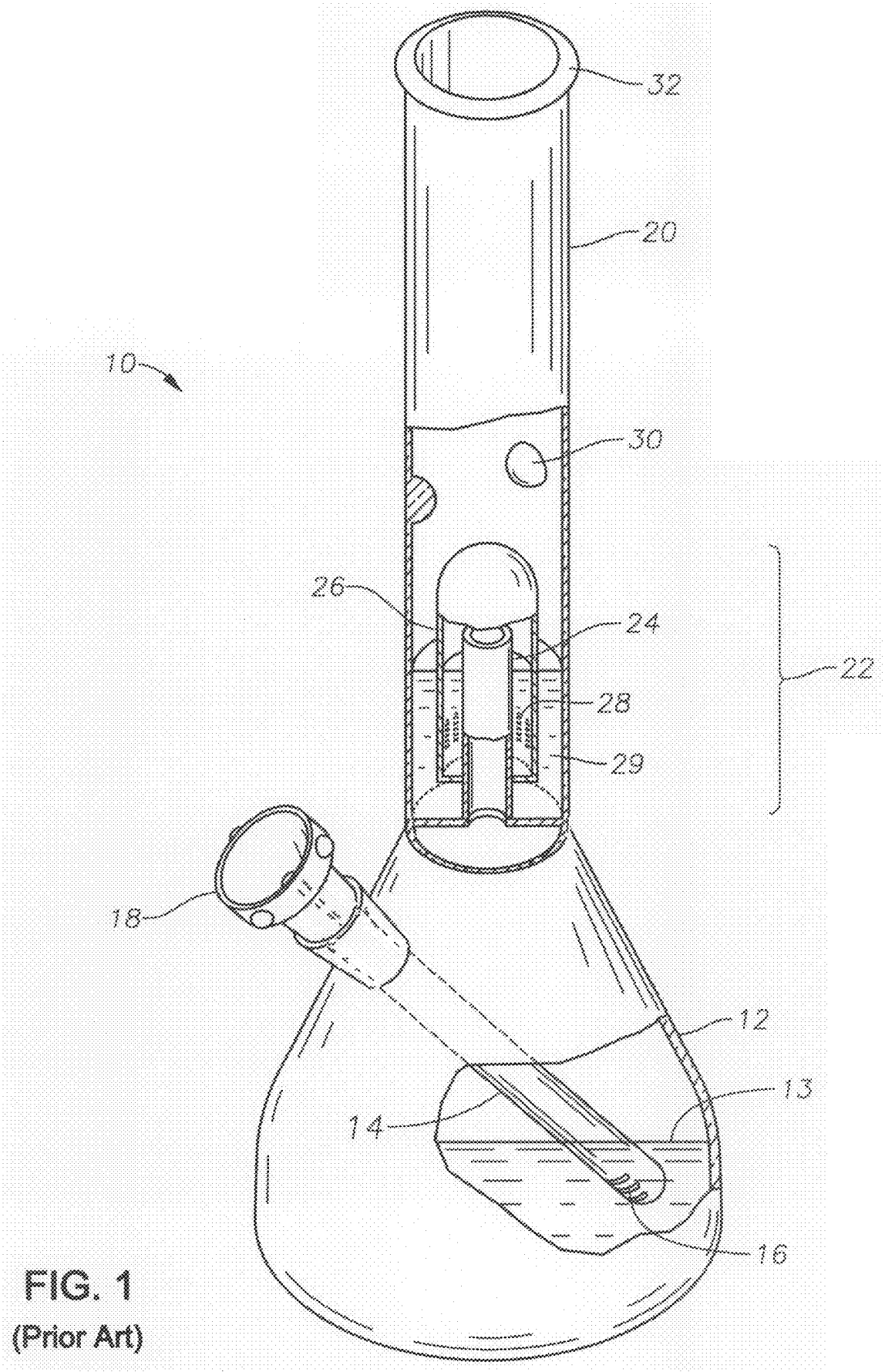
FIG. 1 (Prior Art)
FIG. 1 is an elevational perspective view in partial cross section of a typical water pipe of prior art.
Figure 2:
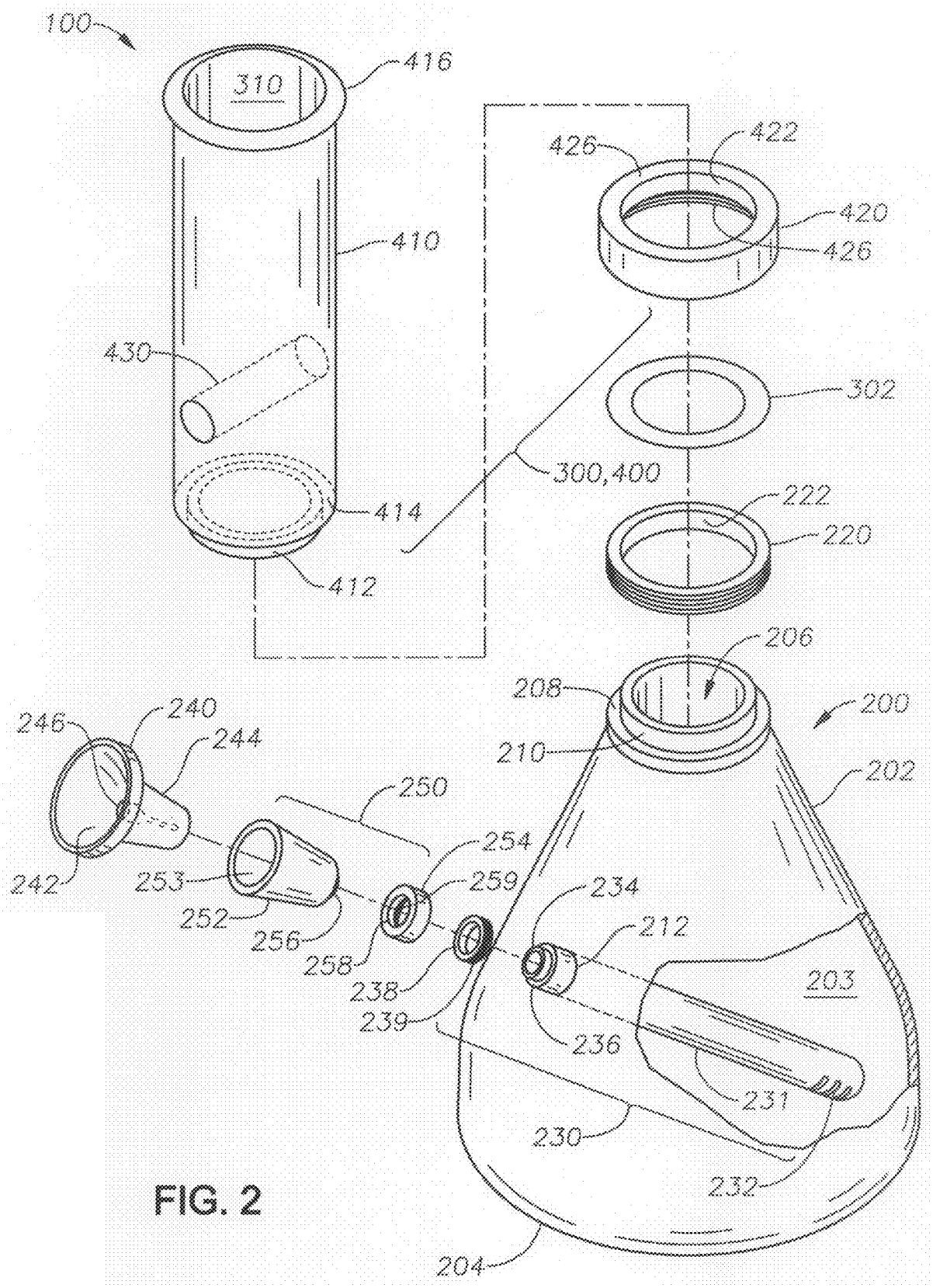
FIG. 2 is an exploded diagram in partial cross section of a water pipe according to an embodiment of the invention, showing a reservoir for containing a filtering liquid, a removable down stem for partial into the reservoir, a bowl adapter and bowl, and a selectively removable elongate chimney terminating with a mouthpiece.

Referring to the exploded diagram of FIG. 2, the components of water flask 100 according to an embodiment are illustrated as a lower reservoir 200 and an upper chimney 300. Reservoir 200 includes a vessel 202, which defines a lower base 204 and an upper opening 206. With reference to the entirety of water pipe 100, upper opening 206 is considered to be medially disposed whereas base 204 is considered to be distally disposed. Base 204 preferably has a relatively large and flat surface that allows water pipe 100 to rest on a flat surface with stability.

Vessel 202 may have a frustoconical shape, as illustrated, although other suitable shapes, for example cylindrical, may be used. Vessel 202 defines an interior volume 203. The upper end of vessel 202 defines a short cylindrical wall 208 that circumvolves opening 206. Wall 208 abuts a lower circular seat 210.

Vessel 202 is preferably made of glass, and more preferably of a low thermal-expansion borosilicate glass such as is suitable for laboratory glassware and kitchenware. However, other types of glass, or other materials, for example acrylic polymers, may be used as appropriate.

Suitable manufacturing methods for blowing, molding, or otherwise forming such glassware (including non-glass alternative materials) are known in the art. If borosilicate glass is used, the wall thickness is ideally between 3 mm and 6 mm, although a thinner wall may be used with a concomitant increase in risk of inadvertent breakage. Thicker walls may also be used as appropriate.

Reservoir 200 also includes a first chimney ring 220. Ring 220 is preferably made of metal, such as aluminum, brass, or stainless steel. Numerous appropriate manufacturing techniques for forming metal components are well established in the art. The inner surface 222 of ring 220 is smooth and has an inner diameter that allows for tight and permanent mating of ring 220 about wall 208. When mated, the bottom surface of ring 220 is disposed adjacent to seat 210 of vessel 202. Ring 220 may be dimensioned for a slip fit about wall 208 and bonded to vessel 202 with a single-part ultraviolet-cured epoxy, for example. Other suitable adhesives may be used as appropriate. Ring 220 may also be dimensioned for a press fit about wall 208. In this case, ring 220 may be heated, thereby temporarily expanding ring 220 and allowing it to be fitted about wall 208; as ring 220 cools and contracts, it will be permanently affixed to vessel 202.

Vessel 202 includes a second opening 212, which may be formed in a sloped portion of the wall of vessel 202. A portion of a down stem 230 is removably received into vessel 202 through opening 212. Down stem 230 may include a medial test tube-shaped member 231 and a distal stem ring 238. The lower, or medial end of down stem 230 has apertures formed 232 therein. Apertures 232 may be slits, for example, although other shapes may be used as appropriate. Ideally, apertures 232 are formed on one longitudinal half of down stem 230 and are oriented to face downwardly toward base 204.

Test tube-like member 231 is ideally formed of the same material as vessel 202, preferably borosilicate glass, although other suitable materials may be used. In one embodiment, down stem 230 forms a glass-glass seal with vessel 202. In this case, the region of vessel 202 surrounding opening 212 may have an increased wall thickness, and opening 212 may have an inwardly tapered profile therethrough. The inner surface of opening 212 may be polished, or it may be frosted. Likewise, the other surface of down stem 230 that mates with opening 212 may have a complementary tapered profile and surface finish to create a removable glass-glass hermetic seal. However, other methods for mating down stem 230 with vessel 202 may be used, including elastomeric grommets or the like. Down stem 230 may also be permanently fused with vessel 202.

The distal end of member 231 defines a short cylindrical wall 234 and adjacent circular seat 236. Stem ring 238, which is preferably made of metal, such as aluminum, brass, or stainless steel, is dimensioned for tight and permanent mating about cylindrical 234 adjacent seat 236. Stem ring 238 is dimensioned so that its inner diameter mates with wall 234 and is joined to down stem 230 in a manner similar to that described, supra, with respect to ring 220 and vessel 202.

Reservoir 200 may also include a bowl 240 and a bowl adapter assembly 250. Bowl 240 is removably connected to bowl adapter assembly 250, which is in turn removably connected to the distal end of down stem 230. Bowl adapter assembly 250 may consist of a tapered receptacle 252 and a receptacle ring 254. In one or more embodiments, receptacle 252 is preferably constructed of borosilicate glass, although other suitable materials may be used. Receptacle ring 254 may be made of a suitable metal or alloy, such as brass, aluminum, or stainless steel. The medial, narrow end of tapered receptacle 252 defines a short cylindrical wall 256 and adjacent circular seat. The inner surface of receptacle ring 252 at the distal side defines a smooth collar 258. Collar 258 is dimensioned with an inner diameter so as to permanently mate about wall 234 of receptacle 252. Receptacle ring 254 is joined to down stem 230 in a manner similar to that described, supra, with respect to ring 220 and vessel 202.

In one or more embodiments, the outer circumferential surface of stem ring 238 at the distal side has male screw threads formed thereupon. Similarly, the inner circumferential surface of receptacle ring 254 at the medial side has complementary female screws threads formed therein. In this manner, receptacle assembly 250 is threaded onto the distal end of down stem 230. The threads may have a slight taper so as for form a fluid-tight, i.e., hermetic seal, or the threads may be straight. In the latter case, a gasket (not illustrated) may be used if desired to effect a fluid-tight seal. Although down stem 230 and receptacle assembly 250 are described and illustrated herein as having male and female threads, respectively, a routineer would recognize that the thread genders can be reversed as known in the art.

Bowl 240 has a distal portion with a larger opening and interior bowl-shaped concavity 242, and bowl 240 has a hollow medial neck 244 having a tapered outer surface. A capillary 246 in concavity extends through neck 244. The inner diameter of capillary 246 is sized to allow combustion fumes to pass through but substantially block ash and ground plant material. Bowl 240 may be formed of borosilicate glass, ceramic, porcelain, or other suitable material capable of withstanding high temperatures resulting from combustion of tobacco or other herbs.

In one or more embodiments, bowl 240 forms a glass-glass seal with receptacle 252. In this case, the interior surface 253 of receptacle 252 may have an inwardly tapered profile therethrough that complements the tapered outer profile of neck 244. The inner surface of receptacle 252 and the other surface of neck 244 may be polished or frosted. Concavity 242 of bowl 240 is in fluid communication with interior volume 203 of vessel 202 via capillary 246, receptacle assembly 250, down stem 230, and apertures 232.

Turning now to chimney 300, in one or more embodiments chimney 300 consists of a mouthpiece module 400, although additional modules may be included, as discussed infra with respect to FIGS. 4-8. Mouthpiece module 400 includes an elongate tube 410 and a second chimney ring 420. The interior volume of tube 410 define a flue 310 of chimney 300.

The lower, medial end of tube 410 defines a short cylindrical wall 412 that abuts a circular seat 414. The upper, distal end of tube 410 defines a lip 416 or similar profile that can provide a comfortable seal with the mouth of a human user of water pipe 100.

Tube 410 is preferably made of glass, and more preferably of a low thermal-expansion borosilicate glass such as is suitable for laboratory glassware and kitchenware. However, other types of glass, or other materials such as acrylic polymers may be used as appropriate. If borosilicate glass is used, the wall thickness is ideally between 5 mm and 9 mm, although a lesser wall thickness may be used with a concomitant increase in risk of inadvertent breakage.

Ring 420 is preferably made of metal, such as aluminum, brass, or stainless steel. The inner surface of ring 420 includes a smooth collar 422 having an inner diameter that allows for tight and permanent mating of ring 420 about wall 412. When mated, the distal surface 424 of ring 420 is disposed adjacent to seat 414 of tube 410. Ring 420 may be dimensioned for a slip fit about wall 412 and bonded to tube 410, such as with a single-part ultraviolet-cured epoxy, for example. Other suitable adhesives may be used as appropriate. Ring 420 may also be dimensioned for a press fit about wall 412. In this case, ring 420 may be heated, thereby temporarily expanding ring 420 and allowing it to be fitted about wall 412; as ring 420 cools and contracts, it will be permanently affixed to tube 410.

Mouthpiece module 400 may include an ice constrictor 430 disposed within tube 410. In one or more embodiments, ice constrictor 430 may take the form of a either a tubular channel or solid rod that crosses a diameter of tube 410. Other arrangements, such as indentations or dimples formed along a region of tube 410, may be used as appropriate. The size of ice constrictor 430 is selected so as to prevent typical ice cubes placed above constrictor 430 from passing by constrictor 430 yet allow ample cross-sectional area in flue 310 for combustion gases to pass with relatively little resistance.

In one or more embodiments, the outer circumferential surface 224 of chimney ring 220 has male screw threads formed thereupon. Similarly, the inner circumferential surface 426 of chimney ring 420 at the medial side has complementary female screws threads formed therein. In this manner, chimney 300 is threaded onto reservoir 200 at opening 206. The threads may have a slight taper so as for form a fluid-tight seal between interior volume 203/flue 310 and the exterior of water pipe 100. Alternatively, the threads may be straight, and a gasket 302 may be used if desired to effect a fluid-tight seal. Although reservoir 200 and chimney 300 are described and illustrated herein as having male and female threads, respectively, a routineer would recognize that the tread genders can be reversed as known in the art.

Operation of water pipe 100 is now discussed with reference to FIG. 3. In operation, reservoir 200 is partially filled with a filtering liquid 260, typically water, so as to cover apertures 232 of down stem 230. Plant material (not illustrated) is placed within concavity 242 of bowl 240. The user places his or her mouth over lip 416 of mouthpiece module 400 and inhales while combusting the plant material with a match or other flame source. The negative pressure induced in water pipe 100 due to inhalation causes smoke from bowl 240 to pass through capillary 246, adapter assembly 250, down stem 230, apertures 232, and filtering liquid 260 into interior volume 203 of reservoir 200, flue 310, and ultimately the lungs of the user. Percolation of the smoke through liquid 260 cools and filters the smoke. As smoke passes through the region of flue 310 above ice constrictor 430, it may be further chilled by passing along ice cubes (not illustrated) if provided by the user. By removing bowl 240 from adapter assembly 250 while continuing to inhale, the negative pressure is rapidly equalized, and the volume of smoke held within water pipe 100 is rapidly introduced into the user's lungs.

The modular nature of water pipe 100 allows chimney 300 to be selectively removed from reservoir 200, which aids in cleaning water pipe 100 after use. Further, it allows selective replacement of an individual component, should either the chimney or reservoir become damaged. Also, as discussed infra with respect to FIGS. 4-8, modularity allows customization of water pipe 100 to suit the tastes of individual smokers.

A plurality of adapter assemblies 240 may be provided, each having an interior tapered profile dimensioned to mate with a different sized bowl neck 244. In this manner, the user can change the bowl size desired for a particular smoking experience without having to change the entire down stem 230. By substituting one adapter assembly 240 for another rather than down stem 230, operation cost of water pipe 100 may be reduced.

Figure 3:
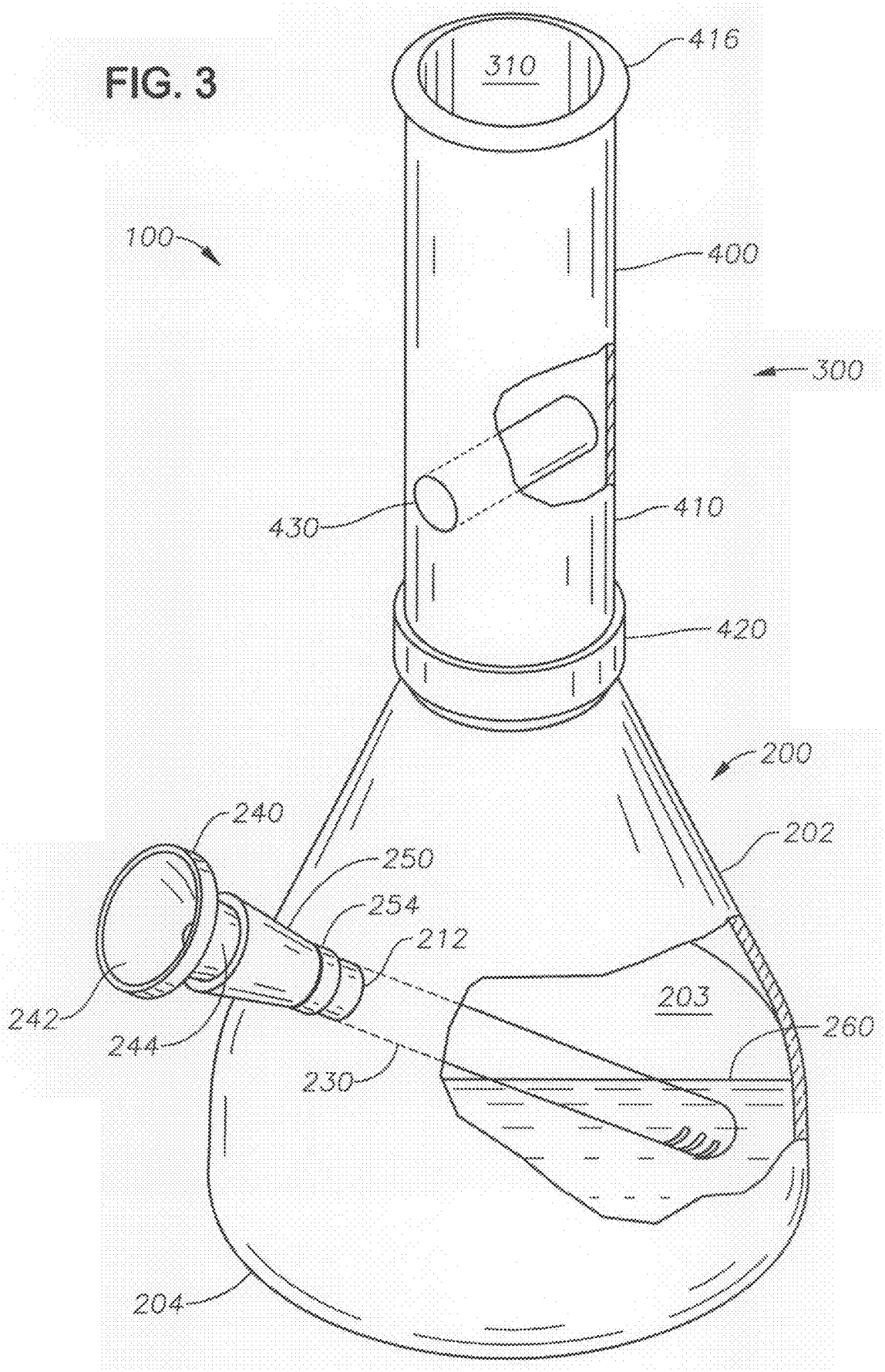
FIG. 3 is an elevational perspective view in partial cross section of the water pipe of FIG. 2.
Figure 4:
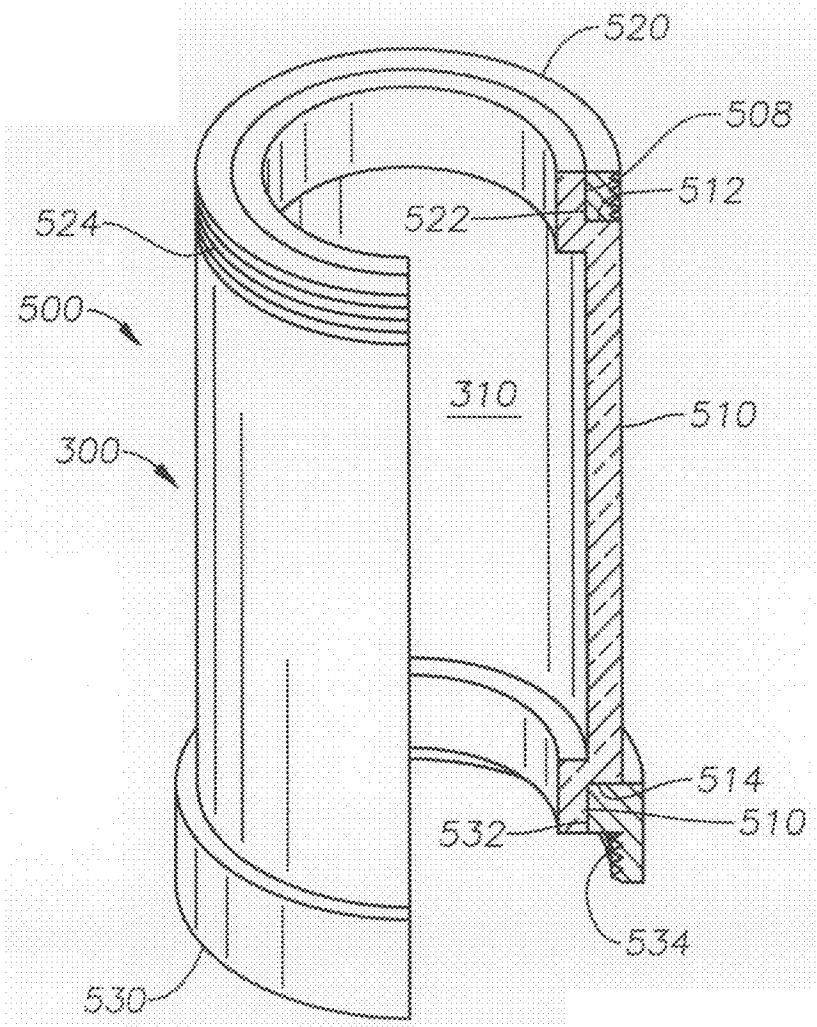
FIG. 4 is an elevational perspective view in partial cross section of an extension module for use with the water pipe of FIG. 2.

FIG. 4 illustrates an extension module 500 that may optionally be used as part of chimney 300, typically in conjunction with mouthpiece module 400 (FIGS. 2-3). Extension module 500 acts to increase to volume of flue 310 within chimney 300, thereby allowing a greater amount of smoke to be inhaled at one time by the user. Referring to FIGS. 2-4, in one or more embodiments, extension module 500 includes an extension tube 510, a distal first chimney ring 520, and a medial second chimney ring 530. As with reservoir 200 and mouthpiece module 300, extension tube 510 is preferably made of borosilicate glass and chimney rings 520, 530 are preferably metallic. However, other suitable materials may be used.

Extension tube 510 is formed with short circumferential walls 508, 510 adjacent circular seats 512, 514 at its distal and medial ends, respectively. First chimney ring 520 has a smooth inner surface 522 that is permanently affixed about wall 508 adjacent seat 512 in a manner as described supra with respect to ring 220 and vessel 202. Likewise, second chimney ring 530 has a collar defining a smooth inner surface 532 that is permanently affixed about wall 510 adjacent seat 514 in a manner as described supra with respect to ring 420 and tube 410.

First chimney ring 520 may be identical or substantially similar to chimney ring 220 of reservoir 200. Likewise, second chimney ring 530 may be identical or substantially similar to second chimney ring 420 of mouthpiece module 400. Regardless of the overall similarity of the rings, threads 524 of ring 520 are identical to the threads of ring 220, and threads 532 are identical to the threads of ring 420, thereby assuring modularity of water pipe 100. In this manner, mouthpiece module 400 may be directly connected to reservoir 200, or extension module 500 may be connected between mouthpiece module 400 and reservoir 200.

Figure 5:
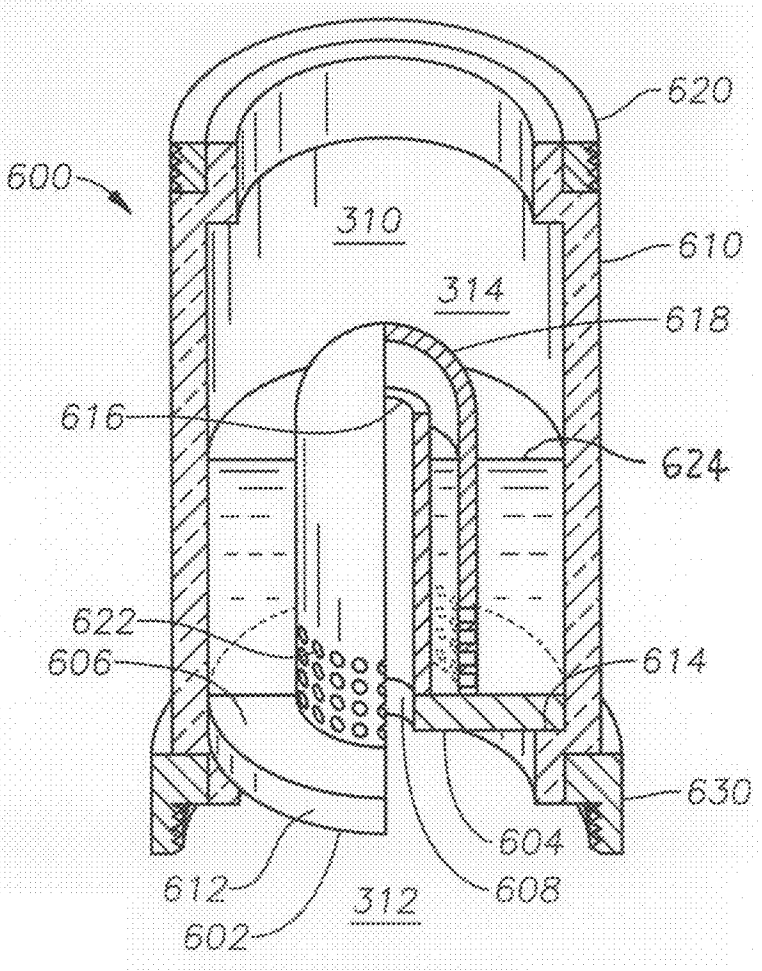
FIG. 5 is an elevational perspective view in partial cross section of a percolation module with a dome-shaped percolation chamber for use with the water pipe of FIG. 2, according to an embodiment of the invention.

FIG. 5 illustrates an embodiment of a percolation module 600 which may optionally be used as part of chimney 300, typically in conjunction with mouthpiece module 400 (FIGS. 2-3). Percolation module 600 includes a tube 610, a distal first chimney ring 620, and a medial second chimney ring 630. Except as noted below, tube 610 and rings 620, 630 are substantially identical to tube 510 and rings 520, 530 of extension module 500 (FIG. 4). Accordingly, details of the construction and assembly of these components is omitted here for brevity.

Percolation module 600 includes a generally planar base 602 having medial and distal faces 604, 606, respectively, and a standpipe opening 608 formed therethrough. Base 602 defines an outer perimeter 612, and tube 610 defines a distally-facing seat 614 located within its inner circumference near the medial end of tube 610. Base 602 is disposed within tube 610 such that medial face 604 abuts seat 614 and perimeter 612 abuts the interior surface of tube 610, thereby forming a circumferential fluid-tight seal with tube 610. Base 602 may be formed separately to tube 610 and thereafter bonded or fused therein, or base 602 and tube 610 may be formed as a unitary structure. Base 602 divides flue 310 into medial and distal interior regions 312, 314, respectively, within tube 610.

Percolation module 600 includes an elongate standpipe 616 having a medial end connected to and sealed against distal face 606 of base 602 circumvolving standpipe opening 608. Accordingly, the interior of standpipe 616 is in fluid communication with medial region 312 of flue 310 via standpipe opening 608. Percolation module 600 further includes a dome-shaped percolation chamber 618 disposed within tube 610 that contains standpipe 616. The medial end of percolation chamber 618 is connected to distal face 606 and includes a plurality of apertures 622 formed therethrough. Standpipe 616 and percolation chamber 618 may be formed separately to base 602 and bonded or fused thereto, or base 602, standpipe 616 and/or percolation chamber 618 may be formed as a unitary structure.

Referring to FIGS. 2-3 and 5, in operation, percolation module 600 is connected within chimney 300 between mouthpiece module 400 and reservoir 200. A filtering liquid 624 such as water is poured into percolation chamber 600 at its medial end, i.e., through mouthpiece module 400, to a level covering apertures 622. As smoke is being inhaled by the user and passes up chimney 300 through flue 310, it passes upwardly through standpipe opening 608 and standpipe 616 into percolation chamber 618. From there it turns downwardly and passes through apertures 622, where it percolates upwardly through filtering fluid 624, thereby providing additional filtering and cooling of the smoke before it passes into the lungs of the user.

Figure 6:
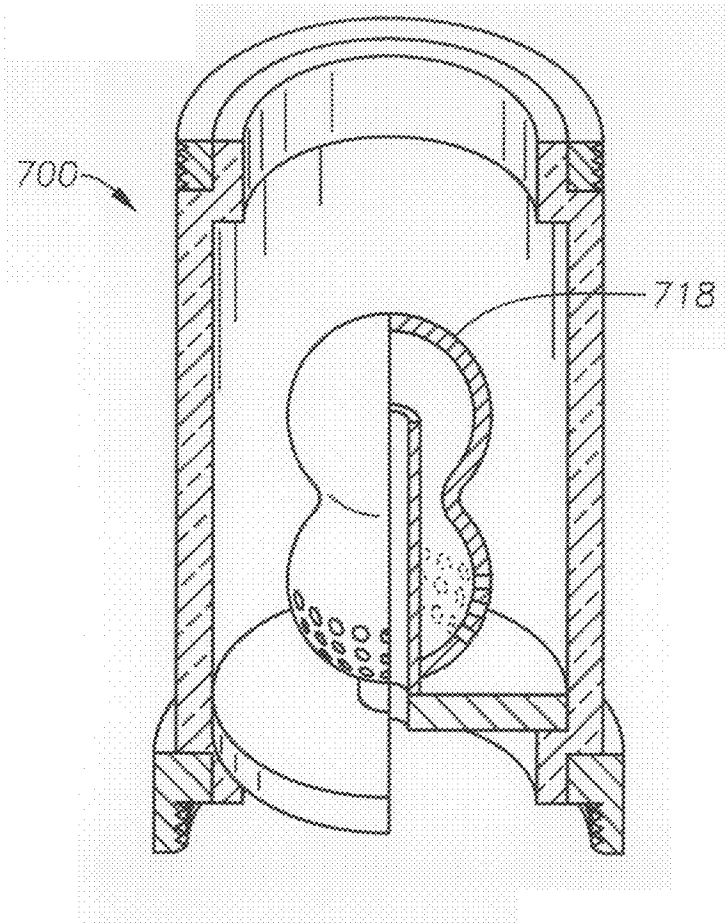
FIG. 6 is an elevational perspective view in partial cross section of a percolation module with an hourglass-shaped percolation chamber for use with the water pipe of FIG. 2, according to an embodiment of the invention.

FIG. 6 illustrates an embodiment of a percolation module 700 which may optionally be used as part of chimney 300, typically in conjunction with mouthpiece module 400 (FIGS. 2-3). As the construction and operation of percolation module 700 is substantially identical to that of percolation module 600 of FIG. 5, for the sake of brevity only the differences are discussed. Rather than a dome-shaped percolation chamber 618 (FIG. 5), an hourglass-shaped percolation chamber 718 is employed. The medial end of percolation chamber 718 is sealed about a medial portion of the standpipe rather than the distal face of the base as is the case of percolation chamber 618 of FIG. 5.

Figure 7:
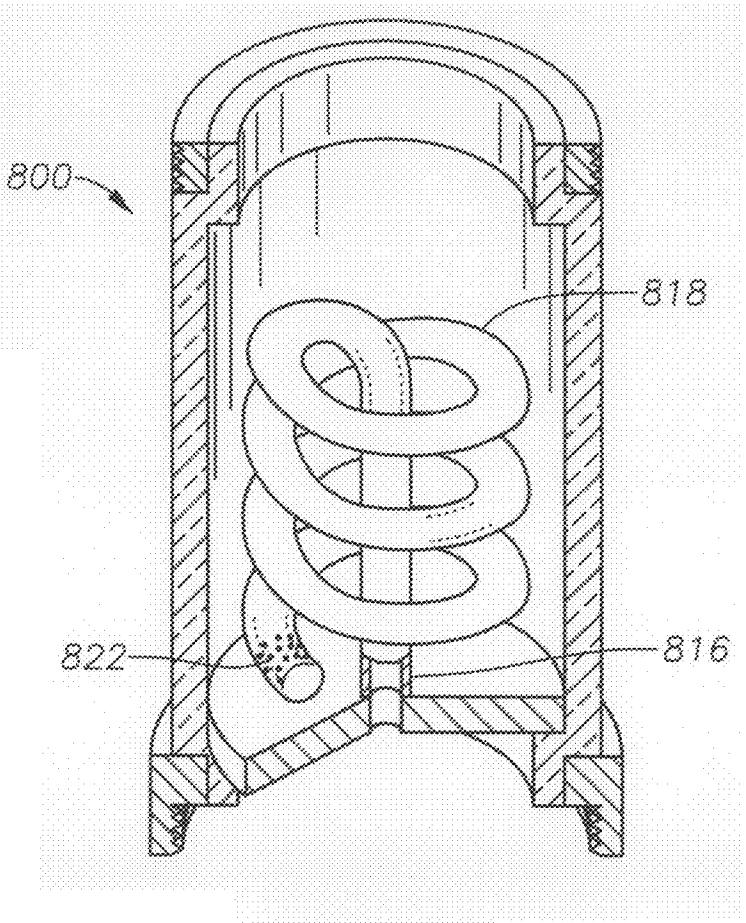
FIG. 7 is an elevational perspective view in partial cross section of a percolation module with a helical-shaped percolation chamber for use with the water pipe of FIG. 2, according to an embodiment of the invention.

FIG. 7 illustrates an embodiment of a percolation module 800 which may optionally be used as part of chimney 300, typically in conjunction with mouthpiece module 400 (FIGS. 2-3). As the construction and operation of percolation module 800 is substantially identical to that of percolation module 600 of FIG. 5, for the sake of brevity only the differences are discussed. Rather than a dome-shaped percolation chamber 618 (FIG. 5), a helical-shaped percolation chamber 818 is employed. Helical percolation chamber 818 is a closed-ended tube that spirals around standpipe 816. In a preferred embodiment, percolation chamber 818 is integrally formed with standpipe 816. The medial closed end of percolation chamber includes a plurality of percolation apertures 822 formed therethrough.

Figure 8:
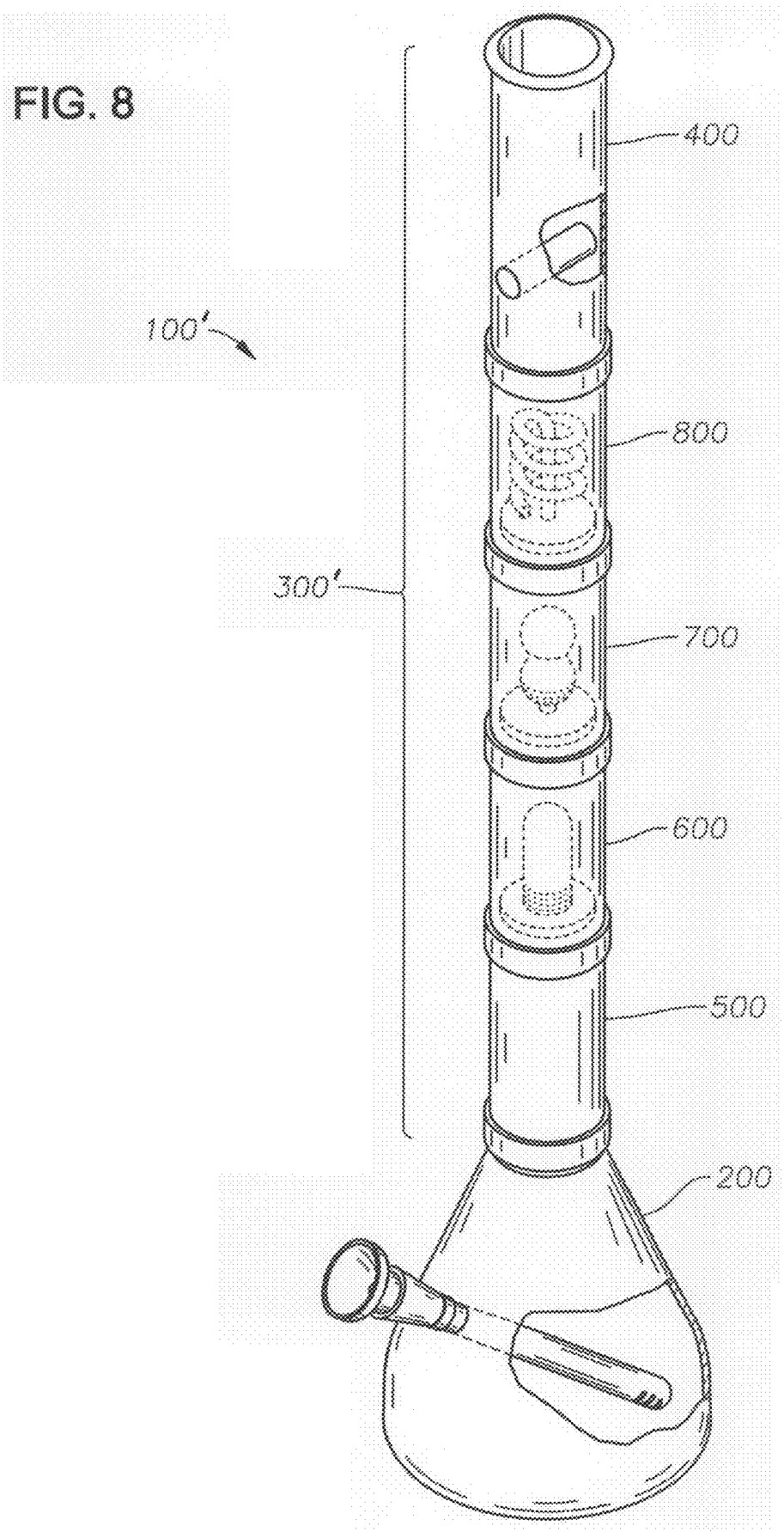
FIG. 8 is an elevational perspective view in partial of a water pipe according to an embodiment of the invention, showing the water pipe of FIG. 1 combined with the optional extension module of FIG. 4 and percolation modules of FIGS. 5-7.

FIG. 8 depicts water pipe 100' according to an embodiment. Water pipe 100' includes reservoir 200 and chimney 300'. Chimney 300' includes mouthpiece module 400, helical percolation module 800, hourglass percolation module 700, dome percolation module 600, and extension module 500, connected in tandem. The order of the percolation modules and extension module may be interchanged, and fewer or additional modules may be used according to the preference of the user. As illustrated, water pipe 100' provides four stages of water filtering and large volume defined by flue 310, although it requires greater lung capacity on the part of the user to use.

Figure 9:
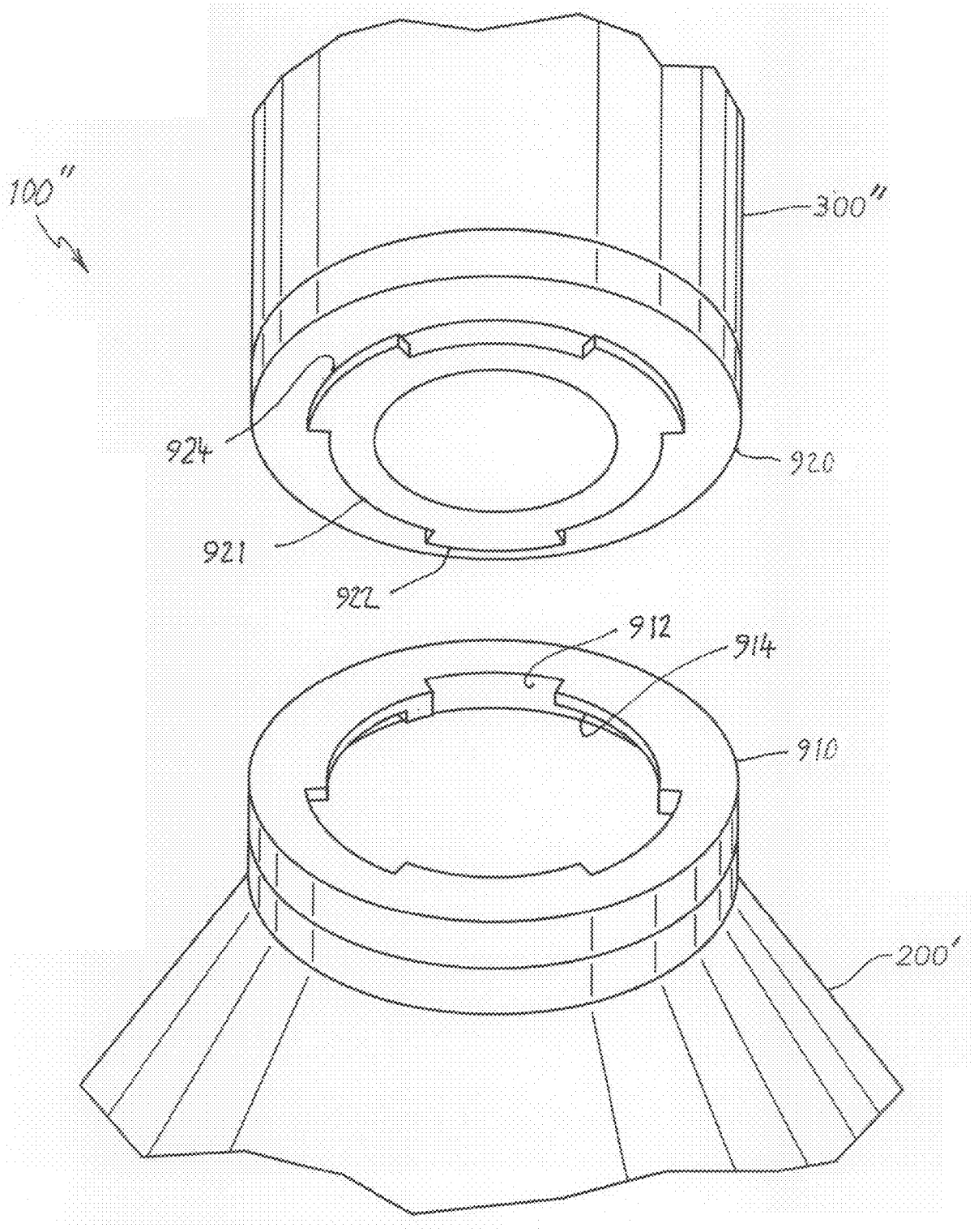
FIG. 9 is a perspective view of a portion of a reservoir and chimney of a water pipe according an alternate embodiment illustrating a cam-lock connection arrangement.

FIG. 9 illustrates the relevant portions of a water pipe 100" according to an alternate embodiment that employs a cam-lock arrangement rather than threaded connections. Components or portions not illustrated are as described supra with respect to water pipe 100 (FIGS. 2-7) or water pipe 100' (FIG. 8). Referring to FIG. 9, water pipe 100" includes a reservoir 200' and chimney 300". Reservoir 200' and chimney 300" include medial and distal metal rings 910, 920, respectively, which are permanently affixed to the glassware (including alternative materials) as previously described.

Along its inner circumference, medial ring 902 includes one or more slots 912. Circumferentially adjacent to each slot 912 is a distally tapered arcuate seat 914. Distal ring 920 defines a medially extending collar 921 that extend into and mates with medial ring 910. The outer circumference of collar 921 includes one or more radially extending tabs 922, one for each slot 912 of medial ring 910, which are dimensioned to fit within slots 912. Each tab 922 defines a tapered distal or upper surface 924. In operation, chimney 300" is axially rotated so that tabs 922 are positioned at slots 912, and collar 921 is inserted into medial ring 910. Chimney 300" is then further rotated a few degrees thereby engaging and wedging tapered tab surfaces 924 against tapered seats 914, thereby selectively attaching chimney 300" to reservoir 200'. Use of a resilient gasket (not illustrated) between rings 910, 920 may be beneficial.

Although distal ring 910 is illustrated and described as having slots 212 and seats 214 (i.e., a female arrangement) and medial ring 920 is illustrated and described as having a collar with tabs 922 with tapered mating surfaces 924 (i.e., a male arrangement), a routineer in the art will recognize that the gender of rings 910, 920 may be reversed, and such falls within the scope of the present disclosure. One skilled in the art will also recognize that all previously disclosed modules will have complementary rings to maintain modularity of water pipe 100". Furthermore, distal stem ring 238 and receptacle ring 254 (FIG. 2) may also employ a cam-lock arrangement instead of threads.

Although FIGS. 2-8 disclose threaded connections and FIG. 9 discloses cam-lock connections, other suitable selective mating arrangements are known in the art. All such connections fall within the scope of the present disclosure. These may include, among others, bayonet-style connectors. Bayonet style connection may be substantially similar to the cam-lock arrangement of FIG. 9, except that the tabs would be angularly small compared to the slots, and at the end of travel the tapered seats would include axial detents into which the tabs are received upon mating. A resilient gasket may be used to apply axial force to keep the tabs securely located within the detents while connected. To disconnect, the tabs need to be axially displaced out of the detents in order to be rotated free and out of the slots.

The Abstract of the disclosure is solely for providing the a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the invention.

What is claimed:

1. A modular apparatus for smoking comprising:

a reservoir defining an interior volume and having first and second openings, said second opening arranged for selective mating with a hollow down stem; and an elongate chimney removably coupled to the first opening, said chimney defining a flue fluidly coupled to the interior volume;

said reservoir including a vessel and a metallic first chimney ring fixed to the vessel at said first opening;

said chimney including a tube and a metallic second chimney ring fixed to a medial end of the tube; whereby said first chimney ring may be selectively mated with said second chimney ring, said chimney includes a percolation module having a metallic medial end adapted for selectively removable connection to the first chimney ring, a metallic distal end adapted for electively removable connection to the second chimney ring, a generally planar base, an elongate standpipe, and a percolation chamber;

said base defines medial and distal faces and an outer perimeter disposed within and fluidly sealed against an interior wall of said tube;

said base includes a standpipe opening formed therethrough;

said standpipe is disposed within the tube and connected at a medial first end to the distal face of the base so as to circumvolve the standpipe opening;

said percolation chamber is disposed within the tube and is fluidly coupled to a distal second end of the standpipe, and said percolation chamber includes a plurality of percolation apertures formed therethrough medially of said second end of the standpipe.

2. The apparatus of claim 1 further comprising:

said down stem, wherein said down stem includes a test tube-like member, a metallic stem ring fixed to a distal end of the test tube-like member, and a plurality of apertures formed through a medial end of the test tube-like member, and said down stem is coupled to and partially received within the reservoir through said second opening, said down stem forming a fluid-tight seal with the reservoir at said second opening.

3. The apparatus of claim 2 further comprising:

an adapter assembly removably coupled to a distal end of the down stem;

said adapter assembly including a receptacle and a metallic receptacle ring fixed to a medial end of the receptacle; wherein said receptacle ring may be selectively mated with said stem ring.

4. The apparatus of claim 1 wherein:

said first chimney ring is threadedly engageable with said second chimney ring.

5. The apparatus of claim 1 wherein:

said chimney includes a mouthpiece module having a metallic medial end adapted for selectively removable connection to the first chimney ring and a distal end arranged for engagement with the mouth of a human user.

6. The apparatus of claim 1 wherein:

said chimney includes an extension module having a metallic medial end adapted for selectively removable connection to the first chimney ring and a metallic distal end adapted for selectively removable connection to the second chimney ring.

7. The apparatus of claim 1 wherein:

said percolation chamber is characterized by a shape selected from the group consisting of a dome, an hourglass, and a helix.

8. A modular apparatus for smoking comprising:

a reservoir defining an interior volume and having first and second openings, said second opening arranged for selective mating with a hollow down stem; and an elongate chimney threaded to the first opening, said chimney defining a flue fluidly coupled to the interior volume, said chimney includes a percolation module having a medial end adapted for selective threaded engagement to said first opening, a distal end adapted for selective threaded engagement to said medial end of said mouthpiece module, a generally planar base, an elongate standpipe, and a percolation chamber;

said base defines medial and distal faces and an outer perimeter disposed within and fluidly sealed against an interior wall of said tube;

said base includes a standpipe opening formed therethrough;

said standpipe is disposed within the tube and connected at a medial first end to the distal face of the base so as to circumvolve the standpipe opening;

said percolation chamber is disposed within the tube and is fluidly coupled to a distal second end of the standpipe, and said percolation chamber includes a plurality of percolation apertures formed therethrough medially of said second end of the standpipe.

9. The apparatus of claim 8 further comprising:

said down stem defining a threaded distal end a medial end having plurality of apertures formed therethrough;

said down stem coupled to and partially received within the reservoir through said second opening and forming a fluid-tight seal with the reservoir at said second opening.

10. The apparatus of claim 9 further comprising:

an adapter assembly threaded to a distal end of the down stem.

11. The apparatus of claim 8 wherein:

said chimney includes a mouthpiece module having a medial end adapted for selective threaded engagement to said first opening and a distal end arranged for engagement with the mouth of a human user.

12. The apparatus of claim 11 wherein:

said chimney includes an extension module having a medial end adapted for selective threaded engagement to said first opening and a distal end adapted for selective threaded engagement to said medial end of said mouthpiece module.

13. The apparatus of claim 8 wherein:

said percolation chamber is characterized by a shape selected from the group consisting of a dome, an hourglass, and a helix.

14. A method of manufacturing a water pipe comprising the steps of:

forming a vessel that defines an interior volume and has first and second openings, forming an elongate tubular chimney;

threading the chimney onto the first opening of the vessel;

forming the first opening to define a circumferential vessel wall;

forming the chimney with a medial end defining a circumferential chimney wall;

forming first chimney and second chimney rings;

fixing the first chimney ring to the vessel about the vessel wall;

fixing the second chimney ring to the medial end of the chimney about the chimney wall;

threading the second chimney ring onto the first chimney ring;

bonding the first chimney ring to the vessel using an adhesive; and bonding the second chimney ring to the chimney using an adhesive.

15. The method of claim 14 further comprising the steps of:

forming the vessel from a glass material; and forming the chimney from a glass material.

16. The method of claim 14 further comprising the steps of:

forming the first and second chimney rings from a metal;

expanding the first and second chimney rings by heating the first and second chimney rings;

pressing the first chimney ring at an elevated temperature onto the vessel about the vessel wall;

pressing the second chimney ring at an elevated temperature onto the medial end of the chimney about the chimney wall; and then contracting the first and second chimney rings by allowing the first and second chimney rings to cool.

* * * * *